US010995905B1

(12) United States Patent
Oliver et al.

(10) Patent No.: US 10,995,905 B1
(45) Date of Patent: May 4, 2021

(54) LIQUID AND GASEOUS FEEDSTOCK STORAGE SYSTEM

(71) Applicant: Firefly Energy Services, LLC, Tulsa, OK (US)

(72) Inventors: Jeff Oliver, Tulsa, OK (US); Brent Smith, Edmond, OK (US); Rick Fizer, Tulsa, OK (US); Kevin Murphy, New York, NY (US); John Fulkerson, Houston, TX (US); Aleisha M. Marty, Coweta, OK (US)

(73) Assignee: FIREFLY ENERGY SERVICES, LLC, Tulsa, OK (US)

( * ) Notice: Subject to any disclaimer, the term of this patent is extended or adjusted under 35 U.S.C. 154(b) by 0 days.

(21) Appl. No.: 16/714,032

(22) Filed: Dec. 13, 2019

Related U.S. Application Data

(60) Provisional application No. 62/779,719, filed on Dec. 14, 2018.

(51) Int. Cl.
*F17C 7/00* (2006.01)
*F17C 1/00* (2006.01)

(52) U.S. Cl.
CPC ..... *F17C 1/007* (2013.01); *F17C 2205/0142* (2013.01); *F17C 2205/0323* (2013.01); *F17C 2221/033* (2013.01); *F17C 2227/0157* (2013.01); *F17C 2250/0426* (2013.01); *F17C 2265/068* (2013.01)

(58) Field of Classification Search
CPC ..... F17C 2221/033; F17C 2205/0142; F17C 1/007; F17C 2227/0157; F17C 2205/0323; F17C 2250/0426; F17C 2265/068
See application file for complete search history.

(56) References Cited

U.S. PATENT DOCUMENTS

| | | | | |
|---|---|---|---|---|
| 2,932,170 | A | 4/1960 | Patterson et al. | |
| 2,948,294 | A | 8/1960 | Smith | |
| 3,108,012 | A * | 10/1963 | Arvel | B08B 9/0551 427/238 |
| 3,950,958 | A | 4/1976 | Loofbourow | |
| 4,709,719 | A * | 12/1987 | Littleton | F16L 55/46 137/268 |
| 4,849,648 | A * | 7/1989 | Longardner | F02C 6/16 290/54 |
| 5,333,465 | A | 8/1994 | McBride | |
| 5,839,383 | A | 11/1998 | Stenning et al. | |
| 6,722,399 | B1 | 4/2004 | Cano | |
| 6,826,911 | B2 | 12/2004 | Carver et al. | |
| 7,854,567 | B2 | 12/2010 | Lourenco et al. | |
| 8,607,830 | B2 | 12/2013 | White | |
| 9,279,533 | B2 * | 3/2016 | Burns | F16L 55/46 |
| 9,359,137 | B2 | 6/2016 | Ram | |
| 9,359,152 | B2 | 6/2016 | James | |

(Continued)

FOREIGN PATENT DOCUMENTS

JP 2275165 7/1998

*Primary Examiner* — Carib A Oquendo

(74) *Attorney, Agent, or Firm* — Head, Johnson, Kachigian & Wilkinson, PC

(57) ABSTRACT

A pressurized gaseous and liquified hydrocarbon feedstock storage system method. The system includes a plurality of underground circuits or sections having parallel pipes joined together by radial ends arranged in various configurations to minimize plot space and maximize the amount of pressurized gaseous fuel stored.

5 Claims, 9 Drawing Sheets

(56) References Cited

U.S. PATENT DOCUMENTS

| | | | | |
|---|---|---|---|---|
| 9,772,068 | B2 | 9/2017 | Mrowzinski | |
| 10,145,512 | B2 | 12/2018 | Barker | |
| 2007/0186564 | A1* | 8/2007 | Hubbard | F17C 9/02 62/50.2 |
| 2008/0236227 | A1* | 10/2008 | Flynn | A01C 21/00 71/7 |
| 2009/0321077 | A1* | 12/2009 | Norman | B08B 9/055 166/311 |
| 2013/0336721 | A1 | 12/2013 | McBride et al. | |
| 2015/0329289 | A1 | 11/2015 | Mercer et al. | |
| 2016/0089705 | A1* | 3/2016 | Oates | C01B 3/52 405/57 |
| 2017/0327237 | A1 | 11/2017 | Saini et al. | |
| 2018/0283610 | A1 | 10/2018 | Wexler et al. | |
| 2018/0306018 | A1* | 10/2018 | Renick | E21B 7/02 |
| 2019/0032853 | A1 | 1/2019 | King | |
| 2020/0033300 | A1* | 1/2020 | Suchard | G01N 29/041 |

* cited by examiner

LIQUID AND GASEOUS FEEDSTOCK STORAGE SYSTEM

CROSS REFERENCE TO RELATED APPLICATIONS

This application claims the benefit under 35 U.S.C. 119(e) of U.S. Provisional Application No. 62/779,719, filed Dec. 14, 2018, which application is incorporated herein and referenced in its entirety.

BACKGROUND OF THE INVENTION

Field of the Invention

The present invention relates to a system and method for providing efficient storage and transfer of compressible gaseous and liquefied hydrocarbons underground in a small plot space and for providing a faster, more affordable and efficient hydrocarbon storage and delivery system for on demand peaking and back-up operations of industrial facilities.

Description of the Related Art

Pressurized gaseous and liquified hydrocarbon feedstock storage is important in providing a reliable feedstock source for industrial facilities at all times. For example, for hot climate gas fired electricity generation, natural gas consumption is highest during the heat of the day and lowest during cooler nighttime hours. The storage of natural gas feedstock allows supply to match demand at various times.

Many industrial facilities, such as powerplants or petrochemical complexes, are connected via pipelines to feedstock, such as natural gas, liquified natural gas components, such as ethane or LNG. In the event of a pipeline supply interruption, and without a reliable storage solution, the industrial facility may negatively suffer operationally or financially.

The commodity value of feedstock varies by contracted period of time—yearly, monthly, daily and hourly. Utility and industrial feedstock users maintain storage to park oversupply and safeguard against market price spikes.

Pipelines for feedstock are generally located underground but, in some situations, above ground. Pipelines placed above ground are subject to security risk, accidental access, and damage. Additionally, above ground pipelines take up valuable surface area, and increase public safety and security concerns.

Large quantities of feedstocks have been traditionally stored underground both in rock bearing depleted reservoirs or desalinated salt deposits. There are various active and inactive underground storage facilities for feedstocks. Historically, underground rock bearing storage methods experience persistent losses due to unconformity in the rock layers. Portions of higher permeability and porosity rock layers, ineffective seals due to failing cement jobs around casing, and inaccurate geological assumptions determining storage design contribute to typical losses. Solid particulates, water, and native hydrocarbon and inert gaseous components need to be removed and processed out of discharged storage feedstock. These typical losses and treatment costs are unforeseen until rock bearing underground storage systems are operational. The present invention eliminates the need for feedstock refining processes and unforeseen losses, thus providing greater quality and quantity control.

A number of prior designs have been utilized for fuel storage. For example, Carver et al. (U.S. Pat. No. 6,826,911) discloses a storage facility embedded in a retrofitted transportation tunnel, such as a decommissioned highway, a railroad, or an aqueduct or tunnel. Natural gas may be delivered from a natural gas transmission line or a rail car.

Stenning et al. (U.S. Pat. No. 5,839,383) discloses a ship or vessel based gas storage system formed of continuous pipe wound in a coil similar to thread on a spool. The primary purpose is for holding natural gas being transported by ship or vessel.

Barker (U.S. Pat. No. 10,145,512) discloses a compressed natural gas storage and dispensing system. The system includes a set of tanks configured in parallel to store compressed natural gas for variability in demand. The system is designed to be used for fueling CNG vehicles.

SUMMARY OF THE INVENTION

Based on the foregoing, it is desirable to provide a gaseous or liquified feedstock storage system positioned between and in fluid communication with a supplying feedstock source and an end-user industrial facility.

It is also desirable to provide a pressurized feedstock storage and transfer system that efficiently and reliably stores and transfers large quantities of feedstock in a small footprint. Because of the serpentine configuration, the amount of pressurized feedstock stored is maximized while the space required, and proximity to use, is minimized. Further, the system is easily maintained based on industry standard pipeline practices and remains functional during times of required maintenance.

It would also be desirable to engineer, procure and construct components within the feedstock storage system from engineering best practices, readily available materials and components, and construction standards. The arrangement of the feedstock storage system provides for scalable capacity and deliverability, and flexibility and customization, which further makes the feedstock storage method economically and operationally desirable.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
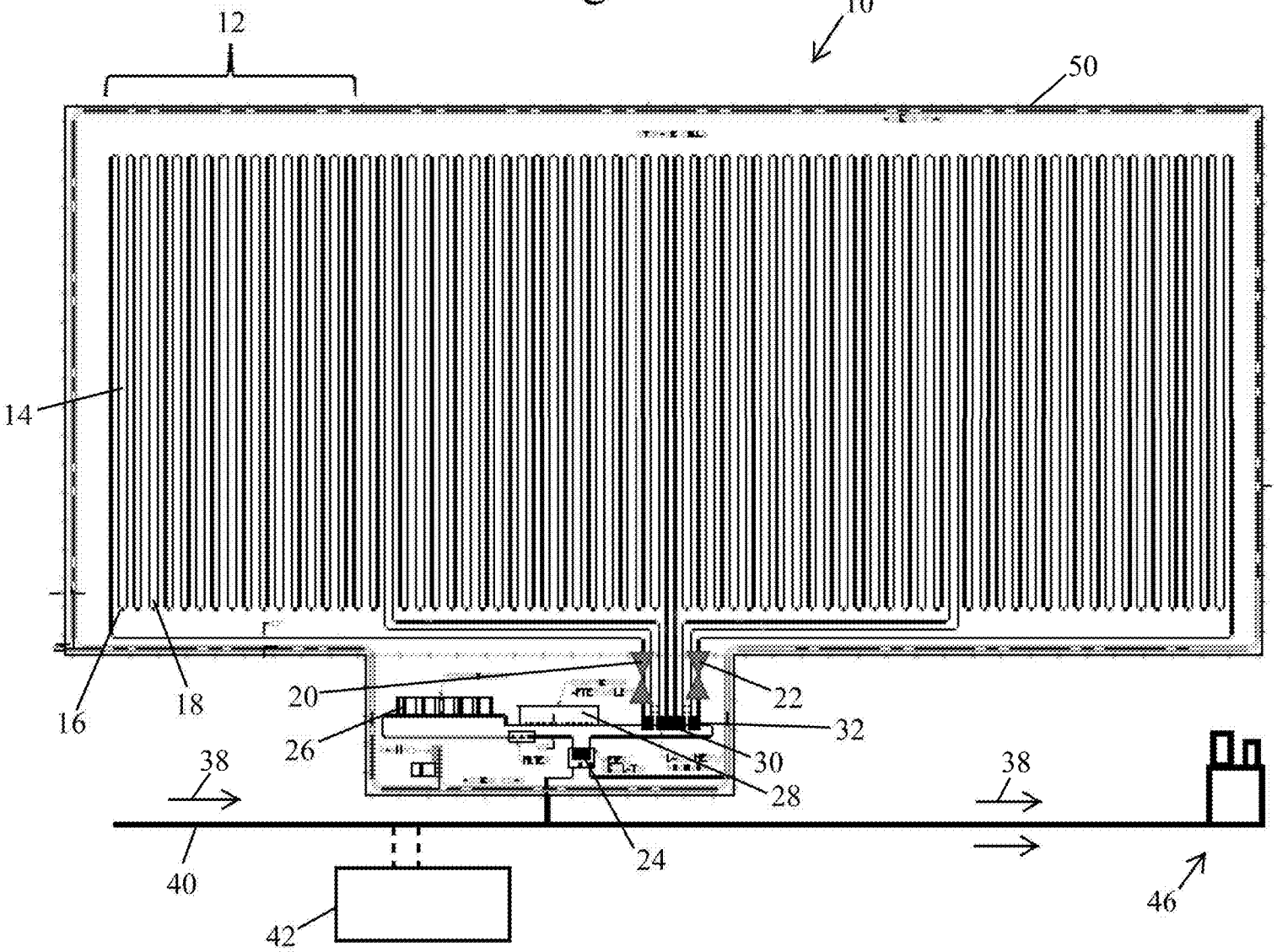
FIG. 1 illustrates a simplified schematic diagram of a first preferred embodiment of a feedstock storage system constructed in accordance with the present invention.

Referring to the drawings in detail, FIG. 1 illustrates a simplified schematic diagram of a first preferred embodiment of a feedstock storage system 10 in a configuration optimal for storing feedstock pressurized natural gas for an industrial facility 46. The system 10 includes a plurality of sections or circuits (one illustrated by bracket 12). In the embodiment shown, four sections or circuits 12 are shown, although a greater or lesser number may be employed. The sections or circuits 12 will be arranged below ground, such as six to twelve feet below ground, subject to soil compaction and pipe diameter. The entire system 10 may be surrounded by a fence 50 or other enclosure.

Each section or circuit 12 includes a plurality of parallel pipes 14. The parallel pipes 14 are joined by elbows or radial ends 16 to form a contiguous elongated chamber 18.

Each of the sections or circuits 12 has an input valve or valve arrays 20 and an output valve or valve arrays 22 so that one section or circuit may be filled while the other is being emptied.

A meter skid assembly and appurtenances 24 for the circuits connects to injection compression assembly 26, and a gas compression aftercooler 28.

A pipeline inspection and cleaning gauge, or "pig", launcher assembly 30 and attending receiver assembly 32 perform pipeline inspection standards. The feedstock storage system 10 can store a gaseous feedstock source, such as natural gas or natural gas components, supplied from a transport pipeline 40 or, alternately, from a docking mobile or marine vessel 42. Arrows 38 illustrate the direction of movement of natural gas in the pipeline 40. Accordingly, the feedstock storage system 10 is logistically positioned between the feedstock source and the industrial facility 46.

Figure 2:
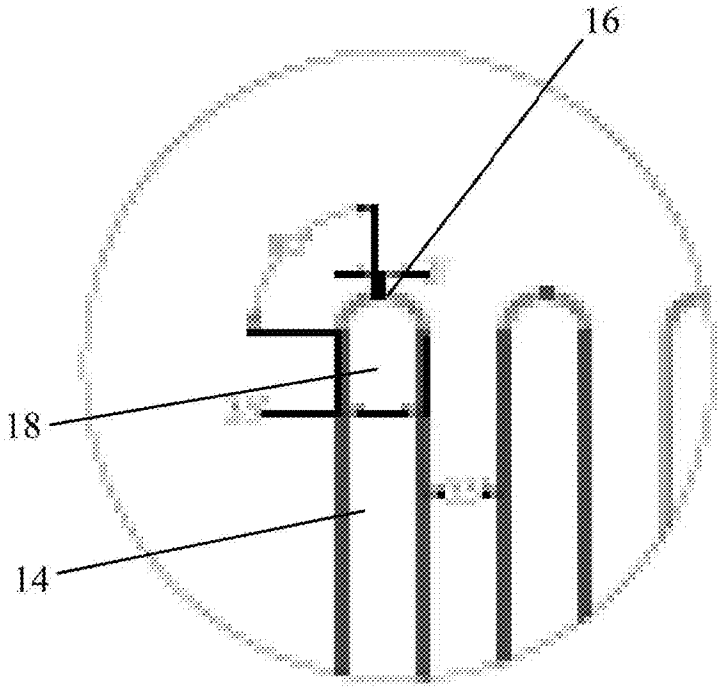
FIG. 2 illustrates an enlarged view of a portion of a plurality of sections or circuits of the feedstock storage system shown in FIG. 1.

FIG. 2 illustrates a portion of one of the sections or circuits 12 apart from the system 10. The elbows or radial ends 16 that form the elongated chamber 18 to store the gaseous feedstock source are shown joining a pair of the parallel pipes 14 together. Both the pipes 14 and the radial ends or elbows 16 may be sourced from readily available components designed for high pressure service.

Figure 3:
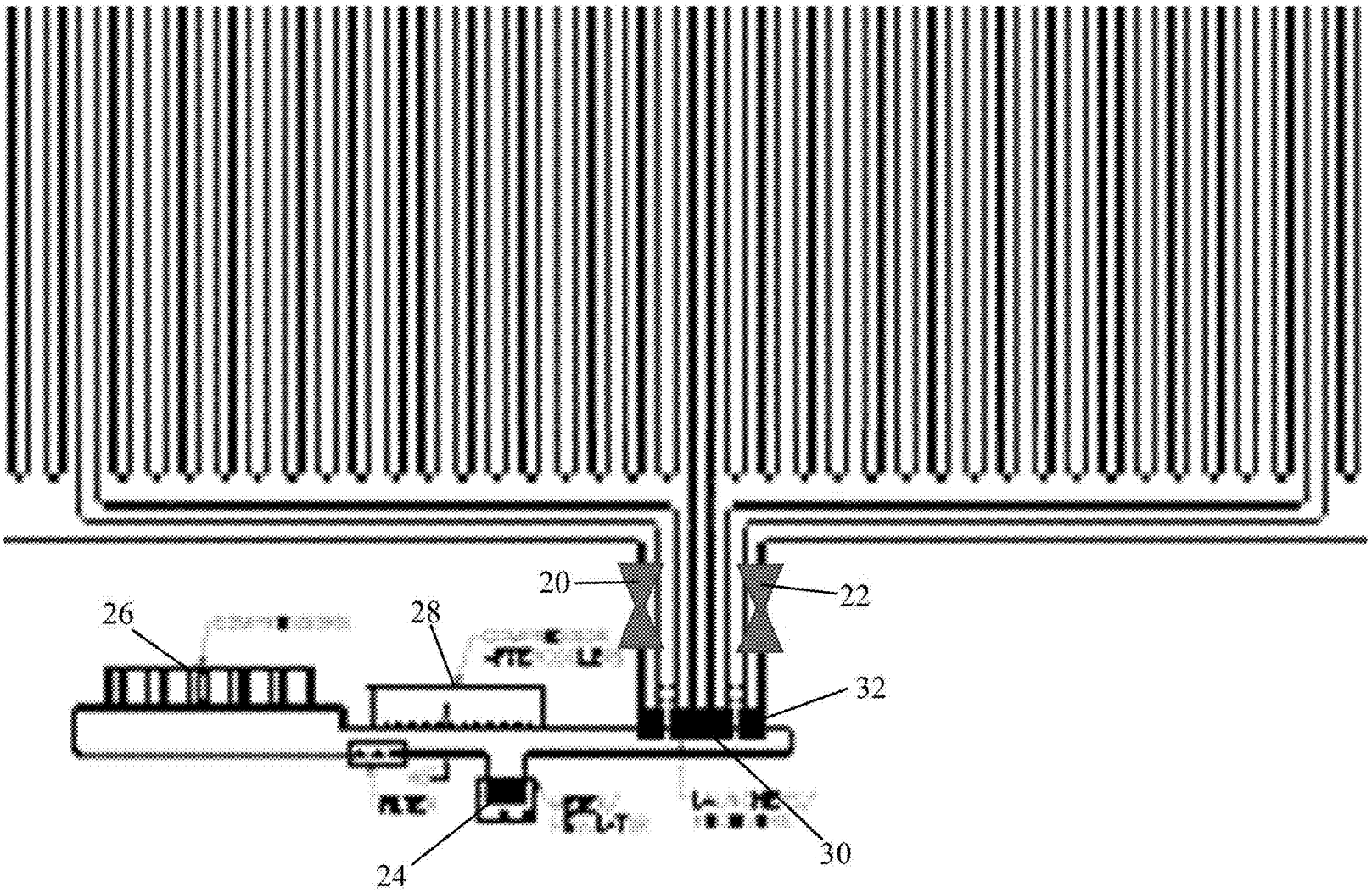
FIG. 3 illustrates an enlarged view of a portion of the feedstock storage system shown in FIG. 1.

FIG. 3 illustrates an enlarged view of a portion of the sections or circuits 12 of the feedstock storage system 10 as they are connected to the launcher assembly 30 and the receiver assembly 32, which are further connected to the injection compression assembly 26 and the compressor aftercooler 28.

Figure 4:
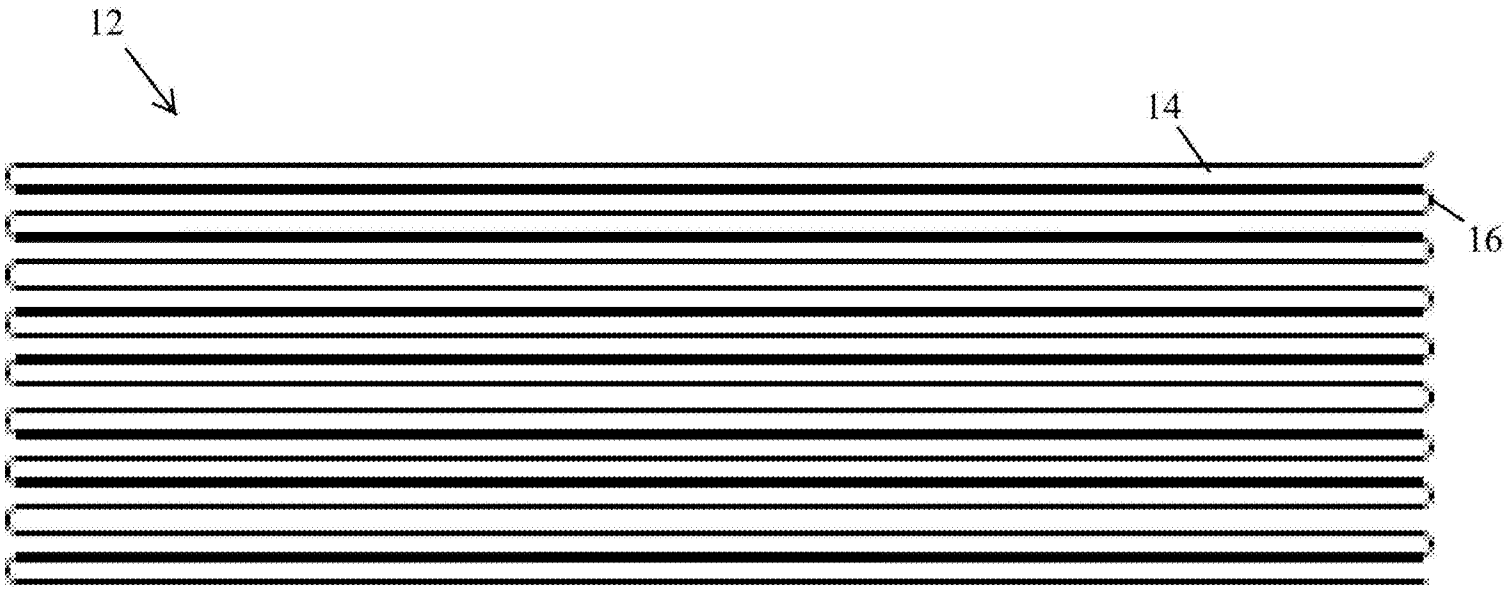
FIG. 4 illustrates a schematic diagram of a portion of one section or circuit of the feedstock storage system shown in FIG. 1.

FIG. 4 illustrates a schematic diagram of one horizontal section or circuit 12 arranged in an accordion or serpentine configuration for storing pressurized gaseous feedstock apart from the system 10. Opening the input valve 20 shown in FIG. 3 permits filling of the section or circuit. Likewise, opening the output valve 22 permits delivery of the feedstock to the facility 46.

Figure 5A:
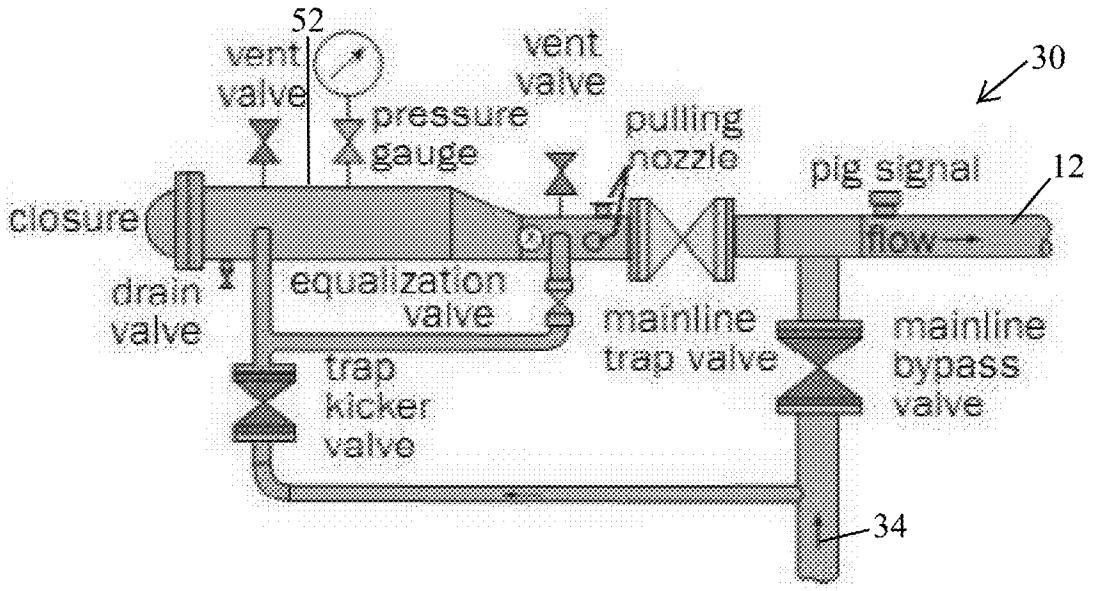
FIG. 5 illustrates a schematic diagram of a launcher assembly and a receiver assembly of the feedstock storage system in accordance with the present invention.
Figure 5B:
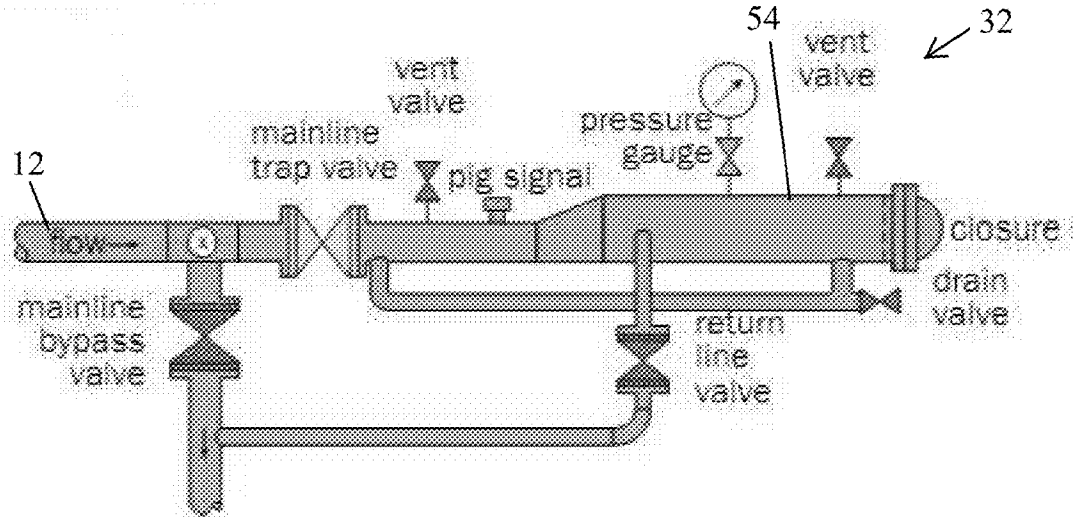

FIGS. 5A and 5B illustrate a diagrammatic view of a preferred pipeline inspection and cleaning pig launcher assembly 30 and a receiver assembly 32 in accordance with the present invention. Arrows 34 show the direction of flow of the gaseous feedstock. A pipeline inspection gauge or pig (not seen) may be periodically used to clean the interior of the circuit and/or used to detect any anomalies in the sections or circuits 12. A pipeline inspection pig (not shown) is inserted into the launcher assembly 30 in an insertion compartment 52 and moved through the section or circuit 12 by differential fluid force.

At an opposed end of the section or circuit 12, the pipeline inspection pig is removed from the circuit by a receiver compartment 54 in the receiver assembly 32. It will be appreciated that modifications to the launcher assembly 30 or receiver assembly 32 may be made within the spirit and scope of the invention.

The present invention permits filling and storage of pressurized gaseous feedstock in multiple chambers during strategic and optimal periods for financial considerations, prevention of supply interruption, or peak demand supply surety.

In another preferred embodiment of the invention shown in FIGS. 6 through 9, a liquified hydrocarbon feedstock storage system 60 is provided. For the storage of liquified hydrocarbon feedstock, operating conditions and control consideration vary from the gaseous feedstock storage embodiments previously described. In the liquid phase, due to compressibility limitations and pressure and temperature limitations, an alternate design has been provided. FIGS. 6 through 9 illustrate liquified hydrocarbon feedstock injection and withdrawal sequential stages utilizing an internally mobile piston assembly 62, in a storage section or circuit 12 that separates a compressible gaseous element 64, such as natural gas, through pressurized lean gas injection or rich natural gas withdrawal 66, maintaining a prescribed pressure envelope on the liquid storage element 68 side of the piston as liquified feedstock is injected or withdrawn.

Figure 6:
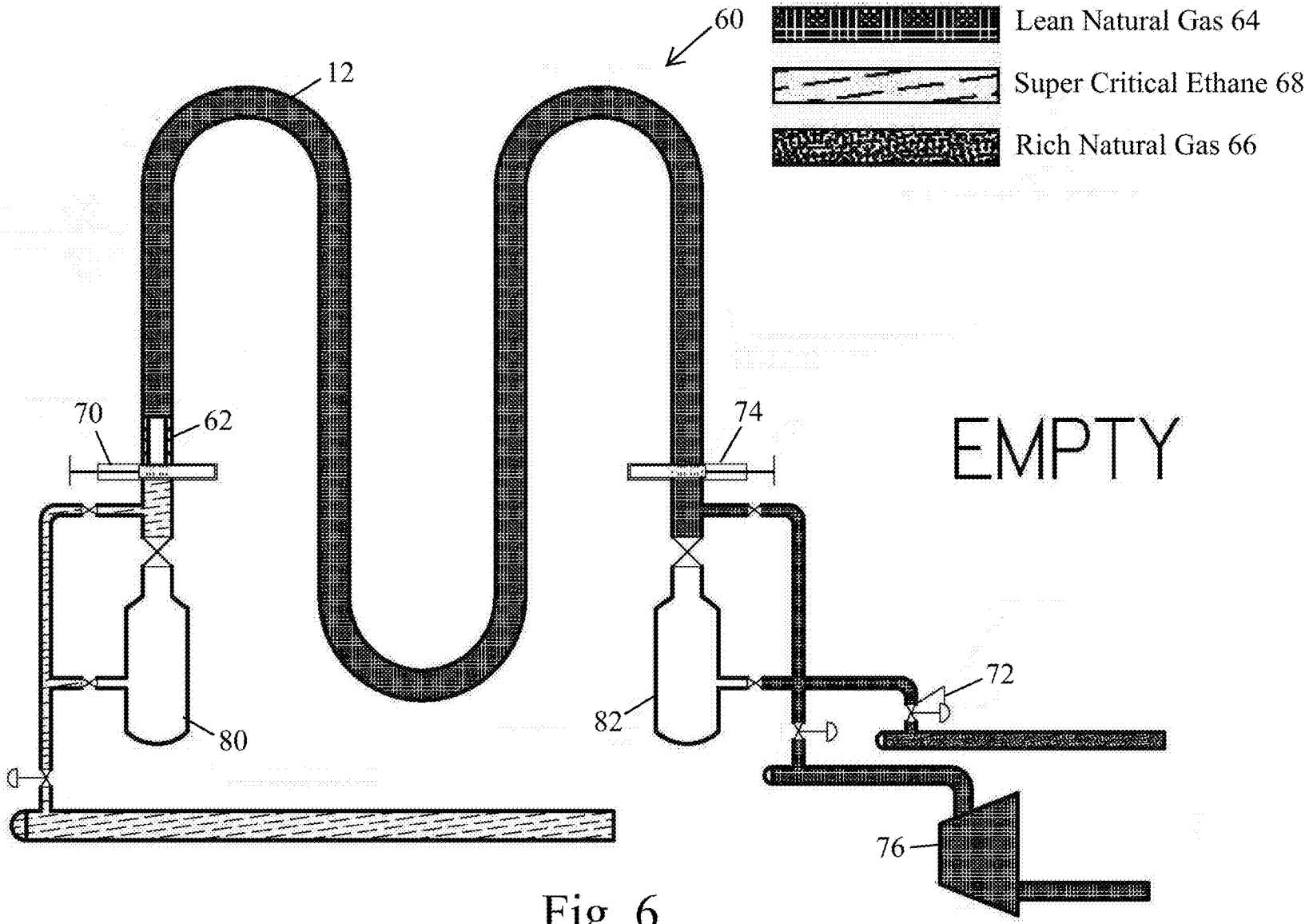
FIG. 6 illustrates a schematic diagram of an alternate, further embodiment to accommodate liquefied hydrocarbon storage through a method of piston placement separating a compressible gas and liquified hydrocarbon.

FIG. 6 illustrates the process stages of the initial fill of the pipeline storage circuit 12 with the bi-directional piston assembly 62 at an initial fill piston stop starting point 70. Piston pressure is maintained by back pressure control valve 72 natural gas initially delivered by lean gas compressor 76.

Figure 7:
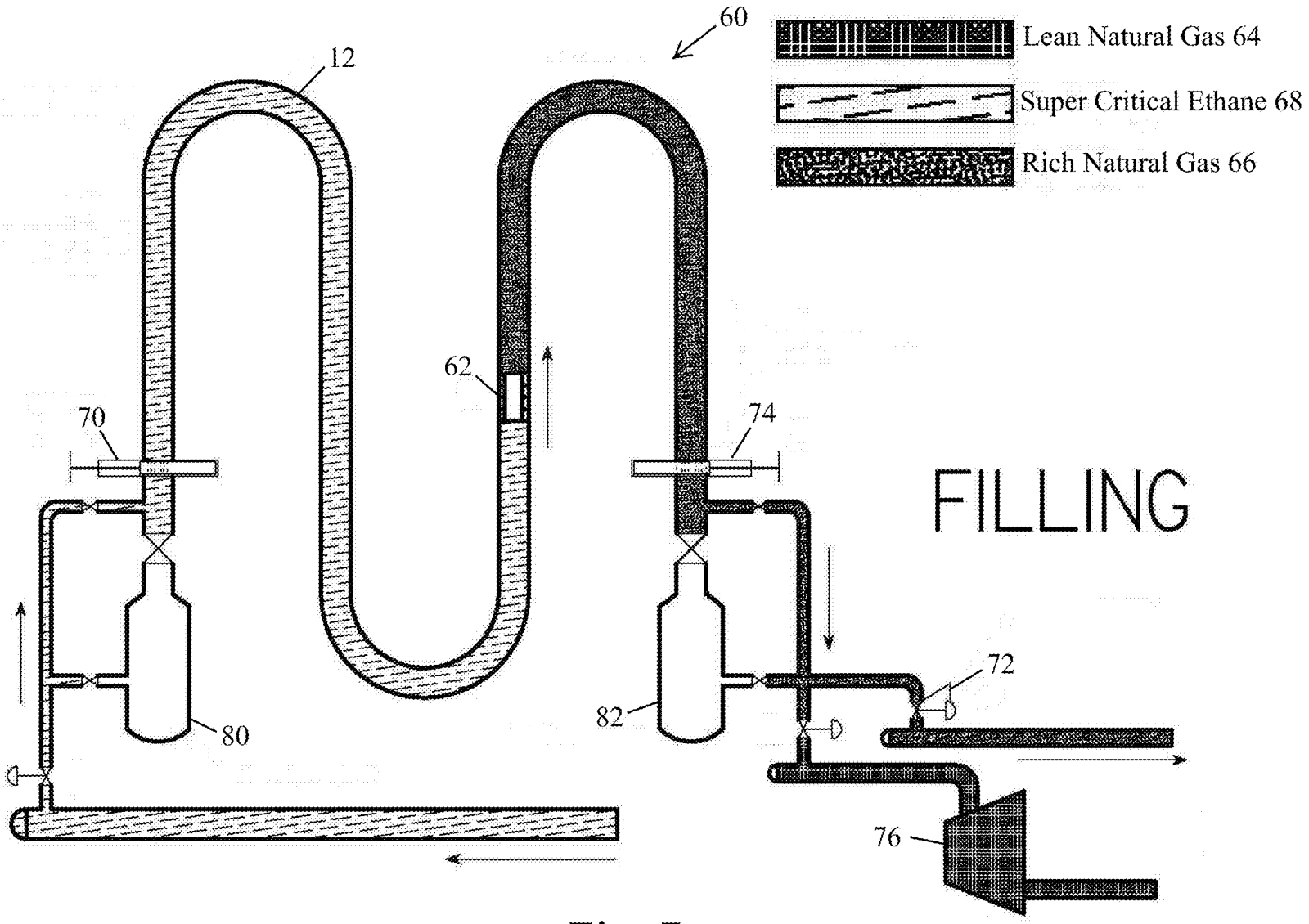
FIGS. 7 through 9 illustrate schematic diagrams of the embodiment shown in FIG. 6 to accommodate liquefied hydrocarbon storage through a method of valve placement accommodating the injection, pressure control and discharge of stored liquified hydrocarbon.

FIG. 7 illustrates the filling process as pipeline storage circuit 12 is introduced with super critical ethane (in one example), moving the bi-directional piston assembly supported by pressure-controlled release of rich natural gas 66 with back pressure control valve 72.

Figure 8:
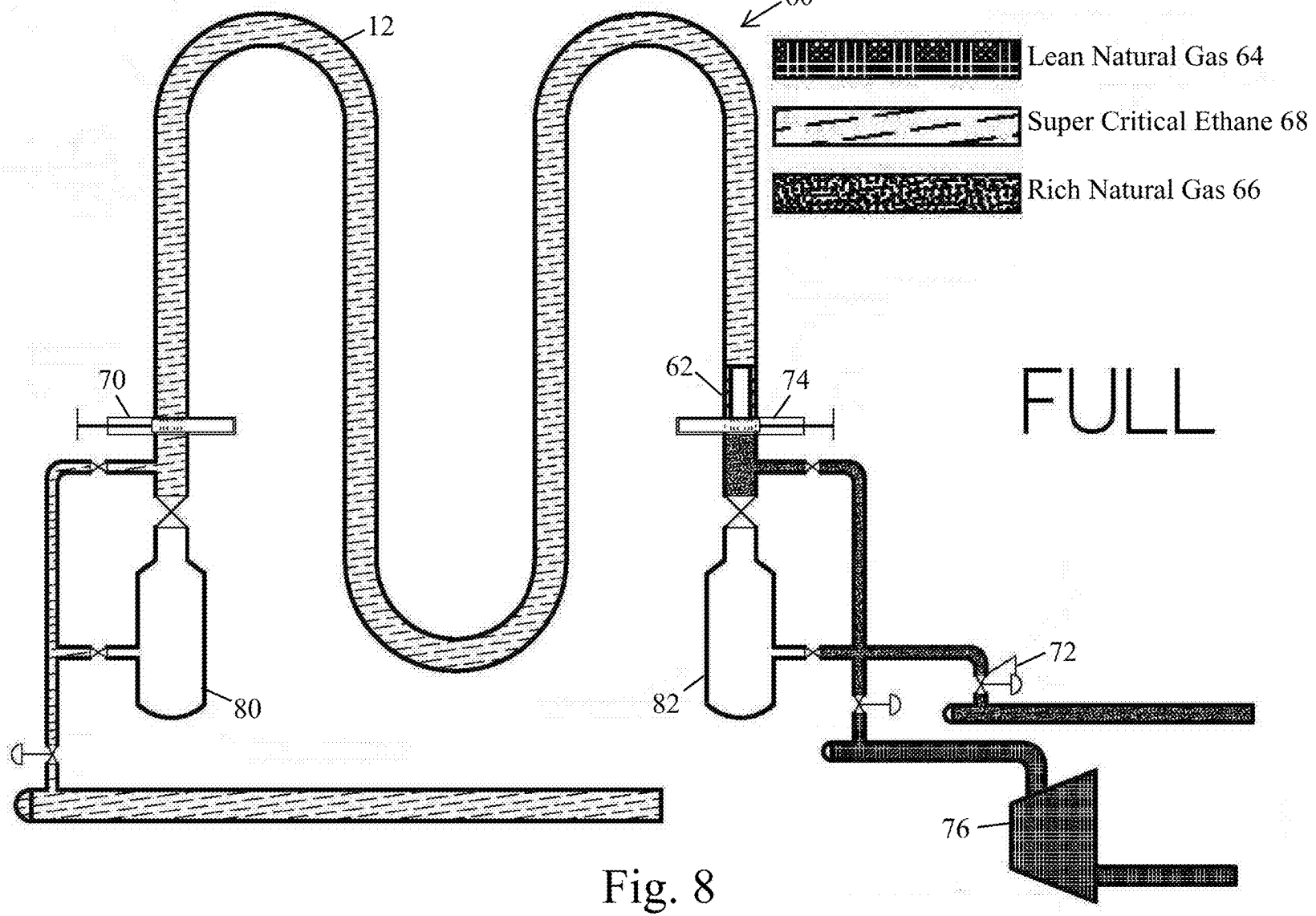

FIG. 8 illustrates the completed pipeline storage circuit 12 filling process with the bi-directional piston assembly 62 at a final fill piston stop 74.

Figure 9:
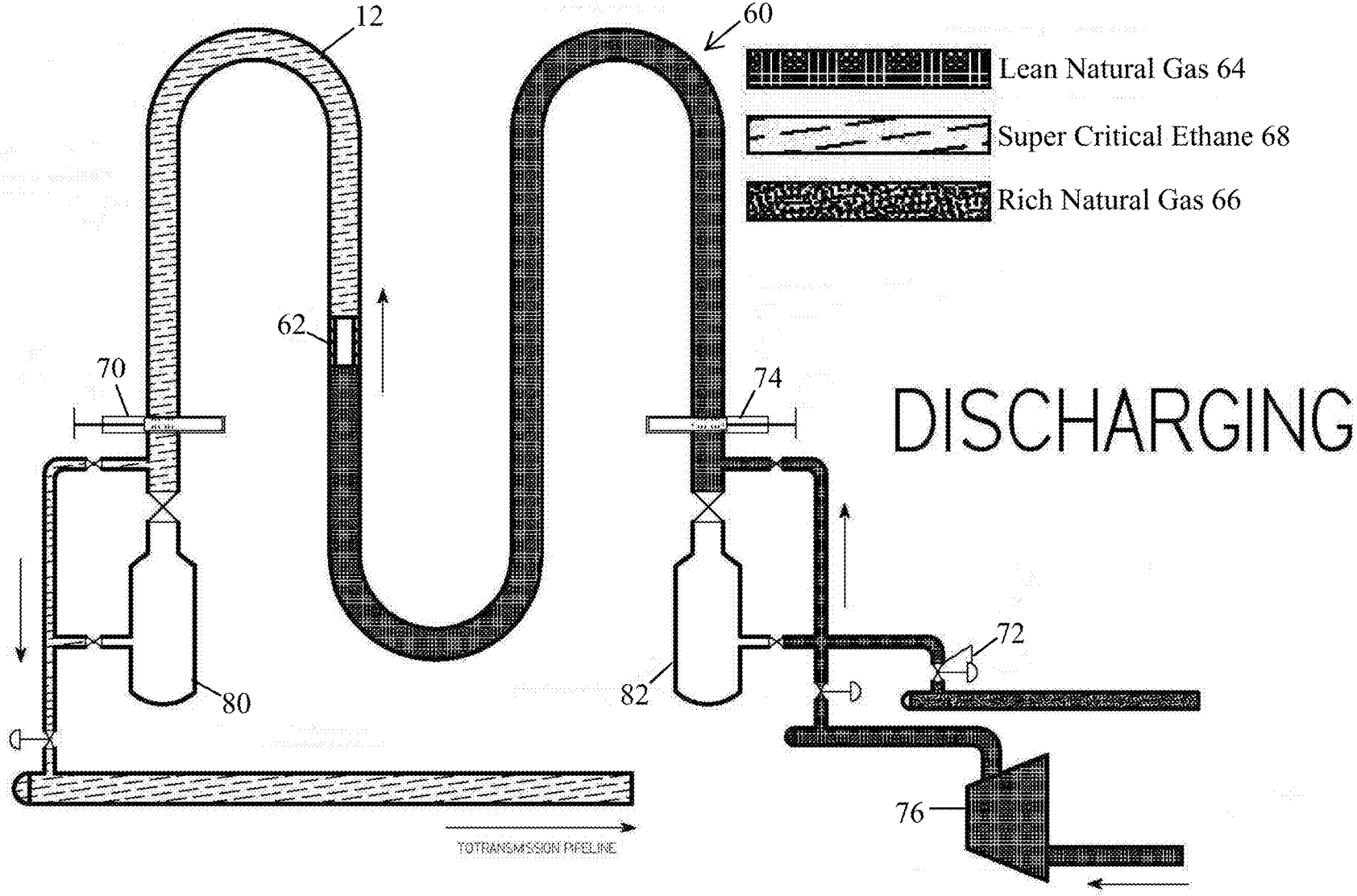

FIG. 9 illustrates liquified hydrocarbon feedstock discharging phase from pipeline storage circuit 12 through the controlled injection of lean natural gas 64 via the lean gas compressor 76.

A similar pipeline inspection and cleaning pig launcher assembly 80 and receiver assembly 82 may be utilized in the system 60 as previously described.

Whereas, the invention has been described in relation to the drawings attached hereto, other and further embodiments or modifications, apart from those shown or suggested herein, may be made within the scope of this invention.

What is claimed is:

1. A liquified feedstock storage system positioned between and in fluid communication with a supplying feedstock source and an end-user industrial facility, said system comprising:

a plurality of circuits, each of said circuits having a plurality of parallel pipes wherein parts of said adjacent pipes are joined together by radial ends to form a contiguous elongated chamber, wherein liquefied feedstock is stored in each of said plurality of circuits;

each of said plurality of circuits having at least an input valve and an output valve;

a meter for each of said plurality of circuits that monitors said liquified feedstock from said source stored in each of said plurality of circuits;

a gas compressor and a gas compressor aftercooler;

an internally movable bi-directional piston assembly separating said liquified feedstock and a compressible gaseous element;

wherein each of said plurality of circuits includes a pipeline inspection and cleaning pig, a pipeline inspection and cleaning pig launcher assembly and a receiver assembly.

2. The liquified feedstock storage system as set forth in claim 1 wherein said launcher assembly and said receiver assembly each include:

a mainline trap valve;

a vent valve;

a mainline bypass valve;

a trap kicker valve;

a drain valve;

a return line valve; and an equalization valve.

3. The liquified feedstock storage system of claim 2 wherein the pipeline inspection and cleaning pig is receivable in the launcher assembly, wherein:

the mainline trap valve can be opened or closed to allow the pipeline inspection gauge to move through said circuit;

the mainline bypass valve can be open or closed to allow the pipeline inspection gauge to further move through said circuit.

4. The liquified feedstock storage system as set forth in claim 1 wherein said plurality of circuits are arranged in a serpentine pattern wherein said valves are used to control said movement of said feedstock source into and out of each said circuits.

5. The liquified feedstock storage system as set forth in claim 1 wherein said plurality of circuits are buried at a chosen depth underground.

* * * * *